US006814142B2

(12) United States Patent
Paulk et al.

(10) Patent No.: US 6,814,142 B2
(45) Date of Patent: Nov. 9, 2004

(54) WELL CONTROL USING PRESSURE WHILE DRILLING MEASUREMENTS

(75) Inventors: Martin Dale Paulk, Houston, TX (US); Carey John Naquin, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/264,577

(22) Filed: Oct. 4, 2002

(65) Prior Publication Data

US 2004/0065477 A1 Apr. 8, 2004

(51) Int. Cl.[7] ..... E21B 21/08

(52) U.S. Cl. ..... 166/250.07; 166/250.15; 175/48

(58) Field of Search ..... 166/53, 91.1, 250.07, 166/250.11, 250.15; 175/48; 73/152.55

(56) References Cited

U.S. PATENT DOCUMENTS

| | | | | |
|---|---|---|---|---|
| 4,063,602 A | | 12/1977 | Howell et al. | 175/7 |
| 4,099,583 A | | 7/1978 | Maus | 175/7 |
| 4,149,603 A | | 4/1979 | Arnold | 175/25 |
| 4,291,772 A | | 9/1981 | Beynet | 175/5 |
| 4,813,495 A | | 3/1989 | Leach | 175/6 |
| 5,842,149 A | | 11/1998 | Harrell et al. | 702/9 |
| 6,176,323 B1 | * | 1/2001 | Weirich et al. | 175/40 |
| 6,296,066 B1 | | 10/2001 | Terry et al. | 175/92 |
| 6,325,159 B1 | | 12/2001 | Peterman et al. | 175/7 |
| 6,348,876 B1 | | 2/2002 | Wei et al. | 340/854.9 |
| 6,581,455 B1 | * | 6/2003 | Berger et al. | 73/152.55 |

OTHER PUBLICATIONS

SPE 77628; G. Wylie, et al; *Well Construction Efficiency Processes Yielding a Significant Step Change*; Presented at the SPE Annual Technical Conference and Exhibition, San Antonio, Tx. Sep. 29–Oct. 2, 2002; (pp. 1–16).

SPE 60750; R. Marker, et al; *Anaconda: Joint Development Project Leads to Digitally Controlled Composite Coiled Tubing Drilling System*; Presented at SPE/CoTA Coiled Tubing Roundtable, Houston, Tx. Apr. 5–6 2000; (pp. 1–9).

* cited by examiner

*Primary Examiner*—Zakiya Walker
(74) *Attorney, Agent, or Firm*—Conley Rose, P.C.

(57) ABSTRACT

Methods and apparatus for monitoring and controlling the pressure in a wellbore characterized by a drilling system utilizing real-time bottom hole pressure measurements and a control system adapted to control parameters such as well shut-in, drilling fluid weight, pumping rate, and choke actuation. In the preferred embodiments, the control system receives input from the bottom hole pressure sensor as well as pressure sensors, mud volume sensors, and flowmeters located at the surface. The control system then adjusts one or more of drilling fluid density, pumping rate, or choke actuation to detect, shut-in, and circulate out wellbore influxes. The preferred system operates automatically without any manual intervention in well control processes.

12 Claims, 2 Drawing Sheets

WELL CONTROL USING PRESSURE WHILE DRILLING MEASUREMENTS

CROSS-REFERENCE TO RELATED APPLICATIONS

This application is related to and filed concurrently with U.S. patent application Ser. No. 10/264,540, titled "Dual Gradient Drilling Using Nitrogen Injection," which is hereby incorporated herein by reference in its entirety.

STATEMENT REGARDING FEDERALLY SPONSORED RESEARCH OR DEVELOPMENT

Not applicable.

BACKGROUND OF THE INVENTION

The present invention relates generally to methods and apparatus for controlling borehole pressure in wells. More specifically, the present invention relates to methods and apparatus employing continuous real-time pressure while drilling measurements to bring borehole pressure back into control after borehole pressure is below pore pressure or greater than fracture pressure.

A drilling fluid is typically used when drilling a well. This fluid has multiple functions, one of which is to provide pressure in the open wellbore in order to prevent the influx of fluid from the formation. Thus, the pressure in the open wellbore is typically maintained at a higher pressure than the fluid pressure in the formation pore space (pore pressure). The influx of formation fluids into the wellbore is called a kick. Because the formation fluid entering the wellbore ordinarily has a lower density than the drilling fluid, a kick will potentially reduce the hydrostatic pressure within the well and allow an accelerating influx of formation fluid. If not properly controlled, this influx is known as a blowout and may result in the loss of the well, the drilling rig, and possibly the lives of those operating the rig. Therefore, when formation fluid influx is not desired (almost always the case), the formation pore pressure defines a lower limit for allowable wellbore pressure in the open wellbore, i.e. uncased borehole.

The open wellbore extends below the lowermost casing string, which is cemented to the formation at, and for some distance above, a casing shoe. In an open wellbore that extends into a porous formation, deposits from the drilling fluid will collect on wellbore wall and form a filter cake. The filter cake forms an important barrier between the formation fluids contained in the permeable formation at a certain pore pressure and the wellbore fluids that are circulating at a higher pressure. Thus, the filter cake provides a buffer that allows wellbore pressure to be maintained above pore pressure without significant losses of drilling fluid into the formation.

In order to maximize the rate of drilling, it is desirable to maintain the wellbore pressure at a level above, but relatively close to, the pore pressure. As wellbore pressure increases, drilling rate will decrease, and if the wellbore pressure is allowed to increase to the point it exceeds the formation fracture pressure (fracture pressure), a formation fracture can occur. Once the formation fractures, returns flowing in the annulus may exit the open wellbore thereby decreasing the fluid column in the well. If this fluid is not replaced, the wellbore pressure can drop and allow formation fluids to enter the wellbore, causing a kick and potentially a blowout. Therefore, the formation fracture pressure defines an upper limit for allowable wellbore pressure in an open wellbore. Typically, the formation immediately below the casing shoe has the lowest fracture pressure in the open wellbore, and therefore it is the fracture pressure at this depth that controls the maximum annulus pressure.

The fracture pressure is determined in part by the overburden acting at a particular depth of the formation. The overburden includes all of the rock and other material that overlays, and therefore must be supported by, a particular level of the formation. In an offshore well, the overburden includes not only the sediment of the earth but also the water above the mudline. The density of the earth, or sediment, provides an overburden gradient of approximately 1 psi per foot. The density of seawater provides an overburden gradient of approximately 0.45 psi/ft. The pore pressure at a given depth is determined in part by the hydrostatic pressure of the fluids above that depth. These fluids include fluids within the formation below the seafloor/mudline plus the seawater from the seafloor to the sea surface. A formation fluid gradient of 0.465 psi/ft is often considered normal. The typical seawater pressure gradient is about 0.45 psi/ft.

In surface and shallow water wells the differential in gradient between the seawater (or groundwater) and the earth often creates a pore pressure profile and fracture pressure profile that provide a sufficient range of pressure to allow the use of conventional drilling techniques. FIG. 1 shows a schematic representation of pore pressure PP and fracture pressure FG. The pressure developed in the wellbore is essentially determined by the hydrostatic pressure of the wellbore fluid, along with pressure variations due to fluid circulation and/or pipe movement. For any given open hole interval, the region of allowable pressure lies between the pore pressure profile, and the fracture pressure profile for that portion of the well between the deepest casing shoe and the bottom of the well.

Clean drilling fluid is circulated into the well through the drill string and then returns to the surface through the annulus between the wellbore wall and the drill string. In offshore drilling operations, a riser is used to contain the annulus fluid between the sea floor and the drilling rig located on the surface. The pressure developed in the annulus is of particular concern because it is the fluid in the annulus that acts directly on the uncased borehole.

The fluid flowing through the annulus, typically known as returns, includes the drilling fluid, cuttings from the well, and any formation fluids that may enter the wellbore. The drilling fluid typically has a fairly constant density and thus the hydrostatic pressure in the wellbore vs. depth can typically be approximated by a single gradient starting at the top of the fluid column. In offshore drilling situations, the top of the fluid column is generally the top of the riser at the surface platform.

The pressure profile of a given drilling fluid varies depending upon whether the drilling fluid is being circulated (dynamic) or not being circulated (static). These two pressure profiles are represented by the static pressure SP and dynamic pressure DP profiles on FIG. 1. In the dynamic case, there is a pressure loss as the returns flow up the annulus between the drill string and wellbore wall. This pressure loss adds to the pressure of the drilling fluid in the annulus. Thus, this additional pressure must be taken into consideration to ensure that drilling is maintained in an acceptable pressure range between the pore pressure gradient and fracture pressure gradient profile.

Because the dynamic pressure DP is higher than the static pressure SP, it is the dynamic pressure at the highest point in the uncased wellbore, i.e. the lowermost casing shoe, that is limited by the fracture pressure FG at depth D1. Correspondingly, the lower static pressure SP must be maintained above the pore pressure PP at the deepest point D2 in the open wellbore. Therefore, the range of allowable pressures for a certain length of uncased wellbore L1, as shown in FIG. 1, is limited by the dynamic pressure DP reaching fracture pressure FG at the casing shoe depth D1 and the static pressure SP reaching pore pressure PP at the bottom of the well D2.

Thus, in common drilling practice, the density of the drilling fluid will be chosen so that the dynamic pressure is as close as is reasonable to the fracture pressure at the casing shoe. This maximizes the depth that can then be drilled using that density fluid. Once the static pressure approaches pore pressure at the bottom of the well, another string of casing will be set and the same process repeated. Even when using conservative drilling techniques, the wellbore pressure may fall out of the acceptable range between pore pressure and fracture pressure and cause a kick. A kick may be recognized by drilling fluids flowing up through the annulus after pumping is stopped. A kick may also be recognized by a sudden increase of the fluid level in the drilling fluid storage tanks. After a kick has been detected, steps must be taken to control the kick.

There are two commonly used methods for controlling kicks, namely the driller's method and the engineer's method. In both methods the well is shut in and the wellbore pressure allowed to stabilize. The pressure will stabilize when the pressure at the bottom of the hole equalizes with formation pressure. The pressure indicated at the surface in the drill string and the casing annulus can be used to calculate the pressure at the bottom of the wellbore. With the well in the shut-in condition, the pressure at the bottom of the wellbore will be the formation pressure.

When using the driller's method, once the wellbore pressure has stabilized, the pumps are restarted and drilling fluid is circulated through the well. The pressure within the casing is maintained so that no additional formation fluids flow into the well and fluid is circulated until any gas that has entered the wellbore has been removed. A higher density drilling fluid is then prepared and circulated through the well to bring the wellbore pressures back to within the desired pressure range. Thus, when killing a kick using the driller's method, the fluid within the wellbore is fully circulated twice.

When using the engineer's method, as the wellbore pressure stabilizes, the formation pressure is calculated. Based on the calculated formation pressure, a mixture of higher density drilling fluid is prepared and circulated through the well to kill the kick and circulate out any formation fluids in the wellbore. During this circulation, the annulus pressure is maintained until the heavy weight drilling fluid circulates completely through the well. Using the engineer's method, the kick can be killed in a single circulation, as opposed to the two circulation driller's method.

The key parameter for well control is determining the formation pressure and adjusting the wellbore pressure accordingly. If wellbore pressure is allowed to decrease below the pore pressure at a certain depth, formation fluids will enter the well. If wellbore pressure exceeds fracture pressure at a certain depth, the formation will fracture and wellbore fluids may enter the formation. Conventionally, downhole pressure is calculated using drill pipe and annulus pressures measured at the surface. To accurately measure these surface pressures, circulation is normally stopped, to allow the downhole pressure to stabilize and to eliminate any dynamic component of wellbore pressure, and the well is fully shut in. This, of course, uses valuable rig time and involves stopping drilling, which may cause other problems, such as a stuck drill string.

Some drilling operations seek to determine formation pressure using measurement while drilling (MWD) techniques. One deficiency of the prior art MWD methods is that many tools transmit pressure measurement data back to the surface on an intermittent basis. Many MWD tools incorporate several measurement tools, such as gamma ray sensors, neutron sensors, and densitometers, and typically only one measurement is transmitted back to the surface at a time. Thus, the interval between pressure data being reported may be as much as 2 minutes.

Transmitting the data back to the surface can be accomplished by one of several telemetry methods. One typical prior art telemetry method is mud pulse telemetry. A signal is transmitted by a series of pressure pulses through the drilling fluid. These small pressure variances are received and processed into useful information by equipment at the surface. Mud pulse telemetry does not work when fluids are not being circulated or are being circulated at a slow rate. Therefore, mud pulse telemetry and therefore standard MWD tools have very little utility when the well is shut in and fluid is not circulating.

Although MWD tools can not transmit data via mud pulse telemetry when the well is not circulating, many MWD tools can continue to take measurements and store the collected data in memory. The data can then be retrieved from memory at a later time when the entire drilling assembly is pulled out of the hole. In this manner, the operators can learn whether they have been swabbing the well, i.e. pulling fluids into the borehole, or surging the well, i.e. increasing the wellbore pressure, as the drill string moves through the wellbore.

Another telemetry method of sending data to the surface is electromagnetic telemetry. A low frequency radio wave is transmitted through the formation to a receiver at the surface. Electromagnetic telemetry is depth limited, and the signal attenuates quickly in water. Therefore, with wells being drilled in deep water, the signal will propagate fairly well through the earth but it will not propagate through the deep water. Thus, a subsea receiver would have to be installed at the mud line, which may not be practical.

Thus, there remains a need in the art for methods and apparatus for determining and adjusting wellbore pressure based on real-time pressure data received from the bottom of a well. Therefore, the embodiments of the present invention are directed to methods and apparatus for using real-time pressure data to automate pressure control procedures that seek to overcome the limitations of the prior art.

SUMMARY OF THE PREFERRED EMBODIMENTS

Accordingly, there are provided herein methods and apparatus for monitoring and controlling the pressure in a wellbore. The preferred embodiments of the present invention are characterized by a drilling system utilizing real-time bottom hole pressure measurements and a control system adapted to automatically control parameters such as drilling fluid weight, pumping rate, and choke actuation. In the preferred embodiments, the control system receives input from the bottom hole pressure sensor as well as pressure sensors, mud volume sensors, and flowmeters located at the surface. The control system then adjusts one or more of the drilling fluid density, pumping rate, or choke actuation to detect, shut-in, and circulate out wellbore influxes.

One preferred embodiment includes a method for detecting and controlling an influx of formation fluids into the wellbore when the drill bit is at the bottom of the hole. Once a kick is detected, either by downhole pressure sensing or by mass flow rate balancing, the well can be shut and the formation pressure measured by the downhole pressure sensor. The downhole pressure measurements may be made once circulation has stopped or while circulation continues. Once formation pressure has been established, the control system adjusts one or more of drilling fluid density, pumping rate, or choke actuation to circulate out wellbore influxes.

Thus, the present invention comprises a combination of features and advantages that enable it to use real-time downhole pressure data to substantially improve management of kicks and other wellbore pressure abnormalities. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
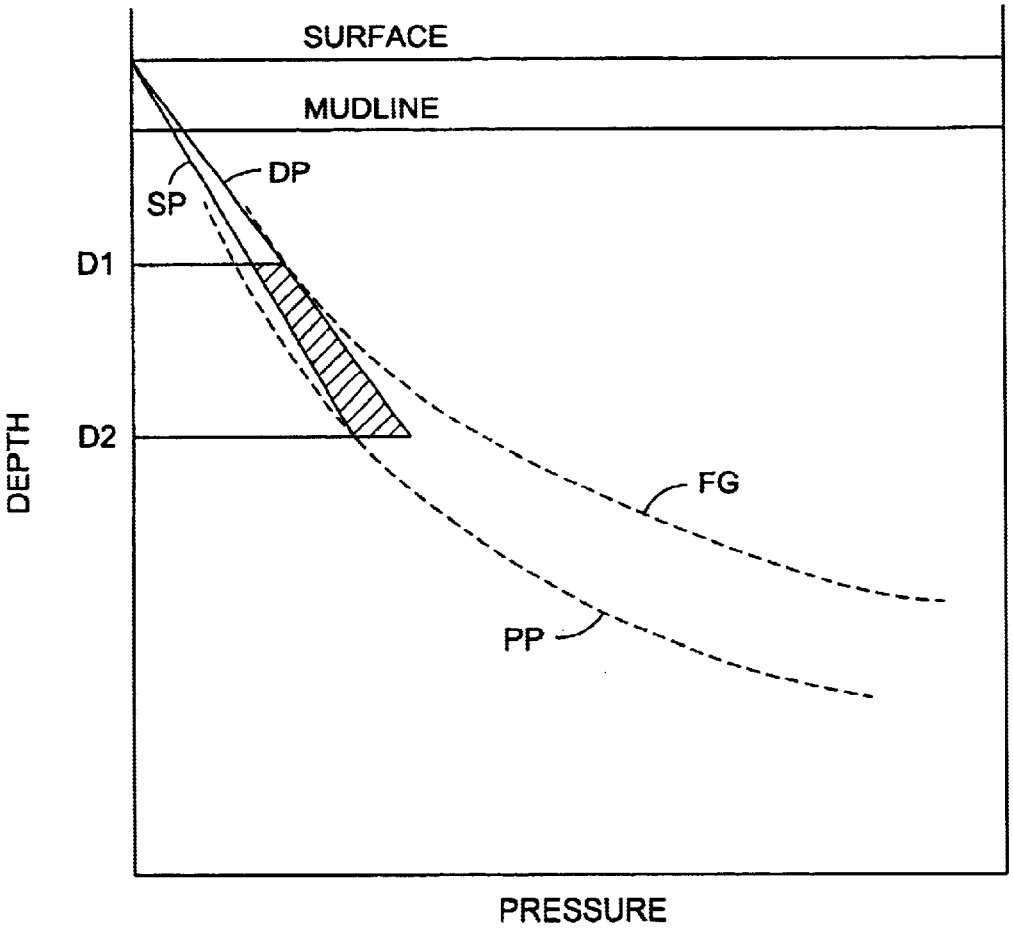
FIG. 1 is a graphical representation of a pressure vs. depth profile for a well.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

In particular, various embodiments of the present invention provide a number of different methods and apparatus for utilizing downhole pressure data in controlling a well. The concepts of the invention are discussed in the context of using downhole pressure data transmitted to the surface via electric signals in a real-time, or near real-time, basis to improve control over a well during a kick. Although the preferred embodiments involve the use of a drillstring providing electrical connection to the surface, such as a composite wired coiled tubing string or an E-coil system, the embodiments of the present invention may be used with any system that is capable of providing real-time, or near real-time, pressure data to a control station.

In the context of the current description, an open wellbore should be taken to mean the uncased, exposed wellbore below the lowermost casing string. Returns refer to the fluid flowing towards the surface through the annulus between the drill string and the wellbore or riser wall. The returns generally include drilling fluid, cuttings, possibly formation fluids, and any other fluids injected into the annulus. Slimhole drilling includes those boreholes having a diameter of 6½" or less, regardless of length of interval. Boreholes with a diameter between 6½" and 8½" may also be considered slimhole if they have a very long interval.

Figure 2:
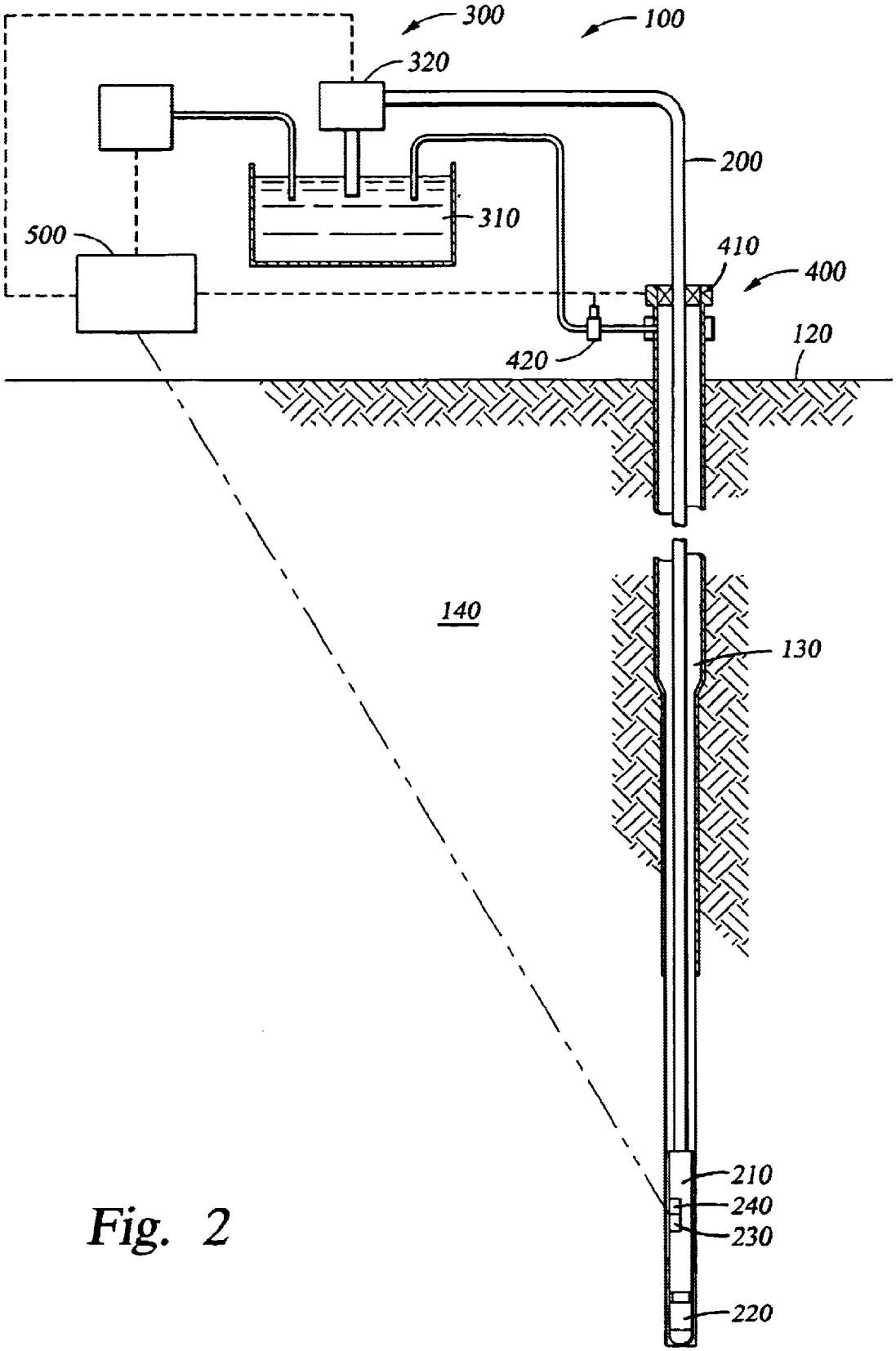
FIG. 2 is a schematic representation of one embodiment of a drilling system constructed in accordance with the present invention.

Referring now to FIG. 2, one embodiment of a drilling system 100 is operated from platform 120 and includes, a drill string 200, drilling fluid system 300, pressure control system 400, and control system 500. System 100 is used to drill well 130 into formation 140. Drill string 200 provides a fluid conduit to and supports bottom hole assembly (BHA) 210 that includes a drill bit 220, pressure sensor 230, and transmitter 240. Drilling fluid system 300 includes a drilling fluid storage 310, circulation pump 320, and drilling fluid density control system 330. Pressure control system 400 includes annulus closure member 410 and adjustable pressure relief device 420.

Drill string 200 is preferably a coiled tubing string capable of two-way communication by transmitting electric signals to and from control system 500 and BHA 210. One exemplary coiled tubing string is a composite coiled tubing string with embedded electrical conductors, as disclosed in U.S. Pat. No. 6,296,066, titled "Well System," and hereby incorporated herein by reference for all purposes. One preferred telemetry system is disclosed in U.S. Pat. No. 6,348,376, hereby incorporated herein by reference. The composite coiled tubing string uses electrical conductors embedded into the wall of the tubing to provide a communication pathway between the surface and a downhole tool. Another method employed to enable communication between a surface control system and a downhole sensor are electric lines run inside a coiled tubing string, known as e-coil. An e-coil system could be used with any type of coiled tubing string. Drill string 200 may also be constructed of any other acceptable tubular material capable of relaying signals between BHA 210 and control system 500.

In the preferred embodiments, the hydrostatic pressure at the bottom of the well is continuously monitored by downhole pressure sensor 230. In a preferred system, transmitter 240 sends the pressure data gathered by sensor 230 to control system 500 as often as once every one-half second. Upon detecting a variance in the bottom hole pressure, counteractive measures can be taken to adjust the wellbore pressure, which is monitored by sensor 230 and can be adjusted accordingly. This monitoring and adjusting is preferably done automatically by control system 500 through the use of software. Thus, the preferred embodiments provide real-time, continuous monitoring of bottom hole pressure.

Drilling fluid system 300 preferably includes a drilling fluid reservoir 310, fluid pumps 320, and a drilling fluid density control system 330. Fluid pumps 320 draw drilling fluid from reservoir 310 and pump pressurized drilling fluid to drill string 200. Pumps 320 are preferably in communication with and controlled by control system 500. In the preferred embodiments, the pumping rate and pressure developed by pumps 320 are electronically, or otherwise, adjustable from control system 500.

Fluid density control system 330 is provided to adjust the density of the drilling fluid. The density may be adjusted by adding additional solids or liquids to the drilling fluid in order to achieve the desired drilling fluid density. In the preferred embodiments, the density adjustments performed by density control system 300 are initiated by control system 500.

Pressure control system 400 is provided to contain and control the pressure in the well annulus. Pressure control system 400 includes at least one annulus closure devices 410 that is adapted to stop the flow of fluid through the annulus. Annulus closure device 410 may be a ram or spherical blowout preventer, a stripper, or any other apparatus designed to close the annulus around the drill string. Pressure control system 400 also includes a pressure relief device, such as choke 420 that can be used to relieve pressure from within the annulus at a controlled rate when the annulus closure device 410 is closed.

The preferred well control system 500 would also be used to remotely control the actuation of choke 420. Typically, prior art chokes are actuated by a manual handle in response to variations in the readings of a surface pressure gauge in order to try to maintain a constant bottomhole pressure. For example, if the pressure starts to rise at choke 420, then the choke will be opened and some of the pressure bled off. Once the pressure decreases, the choke will be closed and the pressure will build back up. Thus, the prior art choke adjustment is based on the surface pressure and not the downhole pressure. By monitoring downhole pressure and choke pressure, the control system of the present invention can improve the adjustment of the choke to maintain the desired constant downhole pressure.

In the preferred embodiments, annulus closure device 410 and pressure relief device 420 are operated by control system 500. Pressure control system 400 may also include pressure sensing devices to measure the pressure in the annulus below annulus closure device 410 and to measure the pressure across pressure relief device 420. Although in the preferred embodiments pressure control system 400 is located at platform 120, in alternative embodiments the pressure control system may be located at the seafloor, or at the base of a riser.

Control system 500 is preferably disposed on platform 120 and is constructed from conventional components and is adapted for use with any drilling system that provides real-time, or near real-time measurements of downhole pressure. Control system 500 may use any combination of electric, electronic, hydraulic, pneumatic, or electro-hydraulic controls. The preferred control system 500 is adapted to control the density and flow rate of drilling fluid entering the wellbore by controlling pumps 320 and the density control equipment 330. Control system also preferably controls annulus closure device 410 and choke 420, which act to control the rate of returns leaving the wellbore.

In the preferred embodiments of the present invention, after a kick is detected and the well is shut in, the downhole pressure will be measured by downhole pressure sensor 230 and transmitted to a control system 500 that will automatically run or operate the well control process. The preferred embodiments of the present invention operate as a closed loop system, i.e. an automatic system requiring no manual operation of any portion of the well control process. The embodiments of the present invention act to automate one or the other of the two prior art well control processes, i.e. the driller's method and engineer's method, by eliminating the measurement of annulus pressure at the surface. By measuring downhole pressure, the embodiments of the present invention eliminate the delay in measuring surface pressure and calculating downhole pressure.

Because the delay is eliminated, there is no reason to shut pumps 320 down or even decrease pumping rates. In the embodiments of the present invention, once a kick is detected, circulation can be continued, i.e. pumps 320 do not have to be shut down or slowed. The system is able to react very quickly to control the kick. In the prior art, it is necessary to go through several different additional steps in the process to attain well control. Alternatively, in the present invention, pumps 320 could be shut down very quickly if necessary. The downhole pressure could then be allowed to stabilize before the system resumes pumping or circulating in the hole. During the interval where the pumps are shut off, typical mud pulse telemetry can not be used. The embodiments of the current invention allow for continued reading of downhole pressure during a period of reduced or stopped circulation.

To maintain a constant downhole pressure, the choke 420 can be adjusted to provide a back pressure to flow or the flow rate into the borehole can be varied by varying the speed of pumps 320. In either case, the density of the drilling fluid would be increased to bring the well into control. The embodiments of the present invention do not change the theory behind well control but serve to automate the process, thereby improving reaction time to well control situations and eliminating delay and human error.

As an example, in the case of a well control situation, one problem in the prior art was in adjusting the drilling fluid density and pumping rates and then determining whether the wellbore pressure has been increased or decreased too much. For example, if there is a kick because the drilling fluid was too light, the formation fluid influx will increase wellbore pressure. The density of the drilling fluid is then increased, but if it increased too much, the hydrostatic head may become so great that it will exceed the fracture pressure and be lost into the formation, causing the kick to develop into a blowout. The real-time downhole pressure measurements provide the necessary information to avoid increasing the density of the drilling fluid pass the desired level.

Another problem, which may occur when well fluids influx into the borehole, is that some of the formation may slough off into the borehole. This material may buildup in the borehole and cause the drilling assembly or other tools to get stuck. This material may also bridge across the borehole and prevent circulation past the bridge in the annulus. This loss of circulation can be quickly identified by an increase in pressure measured by the real-time pressure sensors. Because the embodiments of the present invention can quickly identify a loss of circulation or stuck tool, the preferred control system may also be used to control the use of downhole circulation subs which can be opened to allow continued circulation. Circulation subs may be located at several intervals along the drill string above the bit.

Another advantage of the preferred control systems is that if choke 420 starts to plug or an excessive pressure drop is seen across the choke, then the circulation rate can be changed to maintain constant bottomhole pressure. Therefore, monitoring the pressure at choke 420, so that as the pressure starts to increase or decrease, such as because the annulus is being plugged off or for some other reason the pressure is varying downhole, the preferred well control system 500 would automatically detect that pressure variation at choke 420 and would alter the well control process accordingly.

For example, if the objective of the well control process is to keep the bottomhole pressure at a particular value, and if the pressure at choke 420 is to be maintained at a certain level, the choke orifice size is then either varied or the pump rate is varied based on the pressure at the choke. Conventionally, there is typically a pressure gauge at the choke. In the preferred embodiments of the present invention, there would be an automated pressure gauge at the choke.

The use of real-time downhole pressure measurements also minimizes pressures on the casing shoe during the well control process by decreasing the pressure variations during a well control situation. Because the pressures in the borehole are going up and down, the pressure at the casing shoe may, if not closely monitored, exceed the fracture pressure at the shoe, which is typically the weakest point in the open wellbore.

The preferred embodiments of the present invention also provide the option of being able to stop the circulation process without the risk of introducing additional fluids into the borehole or unnecessarily increasing the pressure in the annulus. Because real-time measurements of the downhole pressure are provided independent of circulation, circulation can be stopped and downhole pressure continue to be monitored without risking the annulus pressure falling below the pore pressure or increasing above the fracture pressure. In the prior art, circulation is stopped until a static condition is established in order to read the surface pressure and then calculate the bottomhole pressure. Circulation may also be continued at a reduced rate without reducing the availability of downhole pressure measurements. Reduced circulation rates may be desirable where there is a choke placing a back pressure on the returns in the annulus. In this case, circulation must be very slow and will therefore not likely support mud pulse telemetry.

With the well shut in, the objective is to maintain a constant downhole pressure as the density of the drilling fluid is increased to kill the kick. As higher density fluid is pumped into the well, one weight of fluid is flowing down into the borehole while another weight of fluid is flowing out of the borehole. Thus it is important to vary the circulation rate to maintain a constant bottom hole pressure, which is very difficult to do by monitoring pressure gauges at the surface. First of all, the surface pressure reading is read after a delay of a bottomhole pressure having propagated up through the borehole to the surface. Thus, the surface pressure reading is based on a downhole pressure reading which occurred at a previous point in time. In the preferred embodiments, the downhole pressures are read real-time.

The embodiments of the present invention avoid an operator at the surface manually measuring surface pressures, then attempting to calculate the dowhole pressures, which takes time to calculate, and then appropriately adjust the weight of the drilling fluid. The preferred embodiments perform those functions all real-time and automatically. In the preferred embodiments of the present invention, the processor computer controls the pump rate, the choke size, and the other parameters associated for well control on detecting a kick.

For example, the well control process could be automated by pumping weighted fluid into the well at variable rates to maintain a constant bottomhole pressure. Another method to automate the process is to pump at a constant rate and then vary the choke size at the surface to maintain a constant pressure in the hole.

Conventionally, an operator monitors the pressure gauge at the surface. However, there is a delay in the surface readings based on bottomhole pressure because the downhole pressure must propagate to the surface. Thus, the adjustment of pumping rates is being performed on a delayed basis relative to the actual pressure changes at the bottom of the hole. However, if the pressure measurements are taken downhole real-time, the downhole pressure is read substantially instantaneously then the well control process can be better controlled.

The preferred embodiments include a remotely controlled, adjustable orifice in the choke maintaining a back pressure on the annulus flow and provides automated control of the choke in order to maintain the desired bottom hole pressure. Further, the density of the fluid being circulated downhole can be controlled by automated fluid density control systems. Not only can the density of the drilling fluid be quickly changed, but there also may be a computer calculated schedule for drilling fluid density increases and pumping rates so that the volume and density of fluid passing through the system is known. The preferably systems may also measure the density and flow rate of the returns flowing out of the well. The pump rate, fluid density, or choke orifice size can then be varied to maintain the desired constant pressure.

In slimhole drilling the monitoring of flow rates becomes very important because a small change in fluid volume in the well translates into a significant height of the well affected. If the flow in equals the flow out, then the well is in control. If the fluid flowing out is greater than the fluid flowing in then there is an influx of well fluids into the borehole. If the volume of fluid flowing in is greater than the volume of fluid flowing out, then drilling fluid is flowing into the formation i.e. leaking of fluid into the formation. This is used for a detection of a kick or a detection of lost circulation.

The density of the drilling fluid and the rate at which the drilling fluid is being pumped through the drill string is easily measured at the surface. The operator will also know the gas injection rate into the riser annulus as well as the density and flow rate of the returns coming out of the well. Therefore, the mass flow rate through the well can be represented by:

$$Q_D\rho_D+Q_I\rho_I=Q_R\rho_R \quad \text{Eq.(1)}$$

where $Q_D$ and $\rho_D$ are, respectively, the flow rate and density of the drilling fluid entering the well, $Q_I$ and $\rho_I$ are, respectively, the flow rate and density of the injected fluid entering the riser, and $Q_R$ and $\rho_R$ are, respectively, the flow rate and density of the drilling fluid exiting the well.

As long as the total rate of fluids into the well equals the total rate of fluids exiting the well, the well is under control. If fluids in equals fluids out, the operator knows the well is under control because the a balanced flow rate indicates that no drilling fluid is passing into the formation and no formation fluid is entering the wellbore. If fluid out is greater than fluid in, then formation fluids are entering the well, i.e. a kick. If fluid out is less than fluid in, then drilling fluid is being lost into the formation i.e. is being lost in the well. Monitoring the mass flow rates into and out of the well provides an alternative to the traditional liquid level monitoring techniques of the prior art.

The flow rate of fluids exiting the well includes cuttings being added at the bottom of the well along with the circulating drilling fluid and the injected fluid. The cuttings, as well as the void at the bottom of the well, are additional factors that must be considered in this calculation. When the bottom of the borehole is drilled, there is a volume loss going in. The volume loss of the cuttings could be subtracted from the components going in. Considering the loss of control, the measurement of cuttings is generally negligible. In looking at a period of drilling time, cuttings measurements becomes negligible or not a factor. The volume loss and the cuttings returning to the surface cancel each other out and can be dropped from the equation. When there is a gas influx, for example, there is a serious jump in the mass flow rate coming out of the well. Therefore, the mass balance method can be used in maintaining control over the well.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A well control method comprising:

measuring pressure with a downhole pressure sensor;

transmitting pressure measurement data to a control system; and adjusting at least one of well shut-in, drilling fluid density, pumping rate, or choke actuation to change downhole pressure, wherein said adjusting is performed by the control system without any manual intervention, wherein the pressure measurement data is transmitted to the control system at least once every second.

2. The method of claim 1 wherein the pressure measurement data is transmitted by electrical conductors along a drill string.

3. The method of claim 2 wherein the drill string is a composite coiled tubing string and the electrical conductors are integrated into the wall of the tubing.

4. The method of claim 2 wherein the electrical conductors are disposed within the bore of the drill string.

5. A method for controlling a well comprising the steps of:

detecting an influx of formation fluids into the well;

regulating the flow of fluids out of the well;

measuring pressure within the well with a sensor disposed on a drill string;

transmitting pressure measurement data to a control system;

monitoring pressure within the well; and adjusting at least one of drilling fluid density, pump rate, or choke actuation so as to maintain a constant pressure within the well as the formation fluids are circulated out of the well and an increased density drilling fluid is circulated into the well, wherein the pressure measurement data is transmitted to the control system at least once every second.

6. The method of claim 5 wherein the control system detects the influx of formation fluids by monitoring pressure data provided by a downhole pressure sensor.

7. The method of claim 5 wherein the control system detects the influx of formation fluids by identifying an imbalance in mass flow rates or volumes of fluids flowing into and out of the well.

8. The method of claim 5 wherein the control system regulates the bottom hole pressure of the well by adjusting choke actuation.

9. The method of claim 5 wherein the pressure measurement data is transmitted by electrical conductors along a drill string.

10. The method of claim 9 wherein the drill string is a composite coiled tubing string and the electrical conductors are integrated into the wall of the tubing.

11. The method of claim 9 wherein the electrical conductors are disposed within the bore of the drill string.

12. The method of claim 5 wherein the adjusting of at least one of drilling fluid density, pump rate, or choke actuation is regulated by the control system.

* * * * *